US010971840B2

(12) United States Patent
Tsai et al.

(10) Patent No.: US 10,971,840 B2
(45) Date of Patent: Apr. 6, 2021

(54) ELECTRICAL CONNECTOR

(71) Applicant: Advanced Connectek Inc., New Taipei (TW)

(72) Inventors: Yu-Lun Tsai, New Taipei (TW); Pin-Yuan Hou, New Taipei (TW); Hsu-Fen Wang, New Taipei (TW); Kang Qin Li, New Taipei (TW); Xi Wang, New Taipei (TW)

(73) Assignee: Advanced Connectek Inc., New Taipei (TW)

( * ) Notice: Subject to any disclaimer, the term of this patent is extended or adjusted under 35 U.S.C. 154(b) by 0 days.

(21) Appl. No.: 16/386,282

(22) Filed: Apr. 17, 2019

(65) Prior Publication Data

US 2019/0326693 A1 Oct. 24, 2019

(30) Foreign Application Priority Data

Apr. 20, 2018 (CN) ..... 201810357294.1

(51) Int. Cl.
*H01R 12/55* (2011.01)
*H01R 12/72* (2011.01)
*H01R 13/405* (2006.01)

(52) U.S. Cl.
CPC ..... *H01R 12/727* (2013.01); *H01R 12/55* (2013.01); *H01R 13/405* (2013.01)

(58) Field of Classification Search
CPC .. H01R 12/7088; H01R 12/718; H01R 12/55; H01R 12/727; H01R 13/6581; H01R 13/6593; H01R 13/02; H01R 13/405; H01R 13/652; H01R 13/642; H01R 24/60; H01R 24/62
USPC ..... 439/78–84
See application file for complete search history.

(56) References Cited

U.S. PATENT DOCUMENTS 4,790,764 A * 12/1988 Kawaguchi ..... H01R 12/585 439/746
8,979,595 B2 * 3/2015 Yen ..... H01R 43/16 29/876
9,537,261 B2 * 1/2017 Chen ..... H01R 13/642
9,647,387 B1 * 5/2017 Gou ..... H01R 12/724
9,935,401 B2 * 4/2018 Tsai ..... H01R 13/652
9,972,952 B2 * 5/2018 Guo ..... H01R 24/60
2010/0015855 A1 * 1/2010 Chiang ..... H01R 27/00 439/660
2010/0173530 A1 * 7/2010 Tsai ..... H01R 27/00 439/660
2012/0015561 A1 * 1/2012 Tsai ..... H01R 27/00 439/660
2015/0194770 A1 * 7/2015 Little ..... H01R 13/6582 439/607.27
2016/0181743 A1 * 6/2016 Tsai ..... H01R 13/5202 439/587
2017/0271823 A1 * 9/2017 Zhao ..... H01R 13/50
(Continued)

*Primary Examiner* — Renee S Luebke
*Assistant Examiner* — Milagros Jeancharles
(74) *Attorney, Agent, or Firm* — JCIPRNET

(57) ABSTRACT

An electrical connector including an insulating body and a plurality of terminals disposed in the insulating body is provided. At least one of the terminals has a first section and a pair of second sections. The second sections structurally extend and branch out from the first section. On a plane where the terminals are located, orthogonal projections of the second sections are misaligned and do not overlap with each other.

17 Claims, 12 Drawing Sheets

(56) References Cited

U.S. PATENT DOCUMENTS

| | | | | |
|---|---|---|---|---|
| 2017/0302031 | A1* | 10/2017 | Cheng | H01R 13/6581 |
| 2017/0310054 | A1* | 10/2017 | Yu | H01R 24/60 |
| 2017/0331229 | A1* | 11/2017 | Cheng | H01R 13/6585 |
| 2017/0373439 | A1* | 12/2017 | Wen | H01R 13/506 |
| 2018/0166830 | A1* | 6/2018 | Feng | H01R 13/6581 |
| 2018/0198246 | A1* | 7/2018 | Cheng | H01R 12/727 |
| 2019/0326698 | A1* | 10/2019 | Tsai | H01R 13/405 |

* cited by examiner

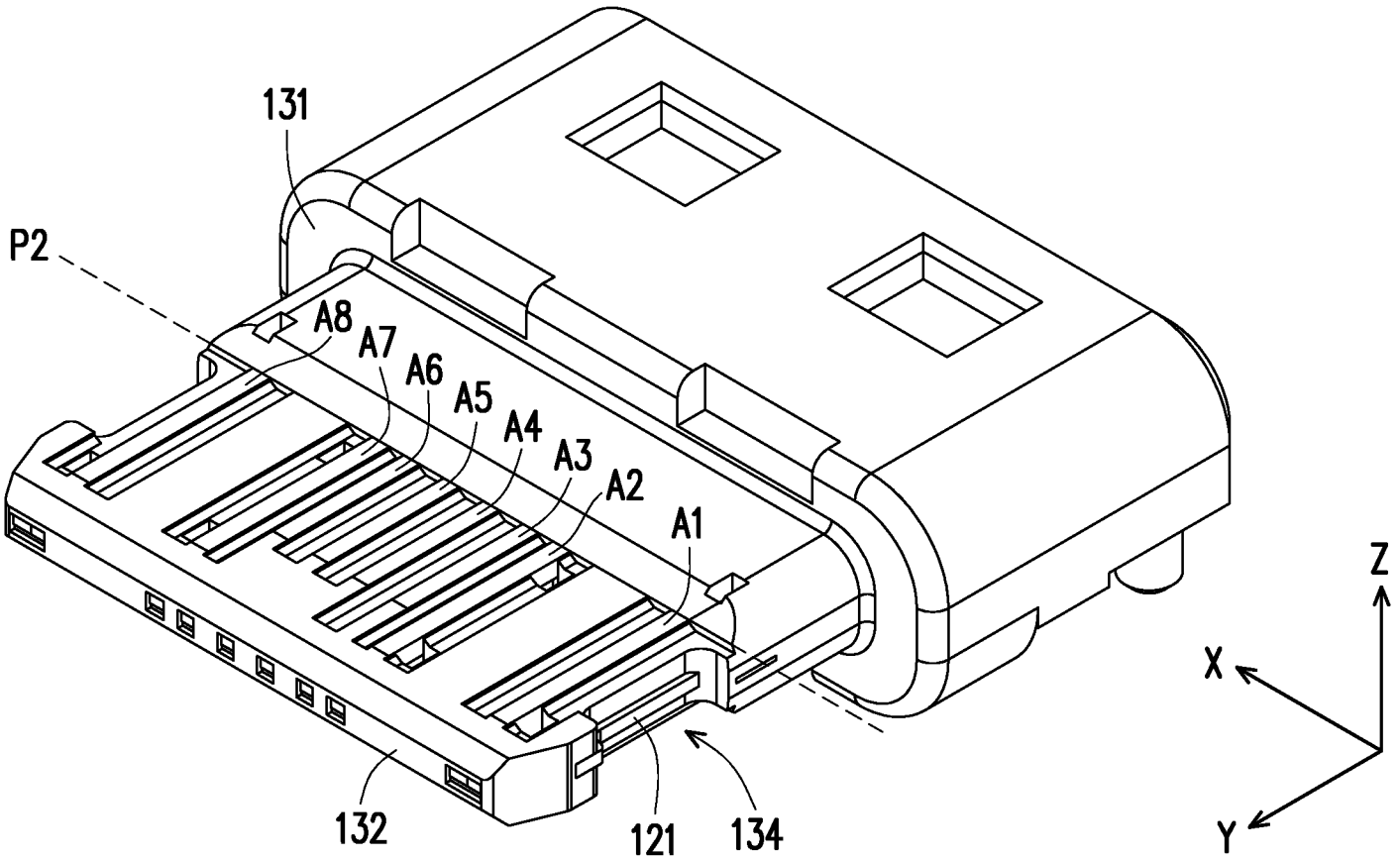
FIG. 2
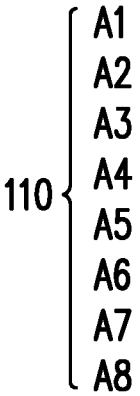

ELECTRICAL CONNECTOR

CROSS-REFERENCE TO RELATED APPLICATION

This application claims the priority benefit of China patent application serial no. 201810357294.1, filed on Apr. 20, 2018. The entirety of the above-mentioned patent application is hereby incorporated by reference herein and made a part of the specification.

BACKGROUND

Technical Field

The disclosure relates to an electrical connector.

Description of Related Art

The Universal Serial Bus (USB) is commonly used by the general public and has developed from the USB 2.0 transmission specification to the current USB 3.0 transmission specification with a higher transmission rate. The appearance, structure, terminal contact mode, number of terminals, pitch between terminals, and pin assignment of terminals of the existing USB Type-C electrical connector are completely different from the current USB electrical connector. Generally, the current USB Type-C electrical receptacle connector includes a plurality of flat terminals disposed in an insulating body, and the insulating body is further covered by a structure such as a metallic shell.

However, in either case, the terminals or the insulating body may be damaged due to improper operation of the user or mis-insertion of other connectors in the process of use. When damaged, the electrical receptacle connector generally needs to be disassembled from a host device (i.e., removing the electrical receptacle connector from the motherboard) to be further replaced or repaired, which results in a complicated process and high maintenance cost.

Furthermore, in the existing USB Type-C electrical receptacle connector, after a plurality of insulating body parts embedded with terminals are first manufactured, the insulating body part, the grounding piece, and another insulating body part embedded with terminals are stacked and assembled together, and it may even be required to further perform a molding process on the above components. Such a process is complicated and the terminals require different pressing molds. The process is complicated and requires high precision, so it is likely to have a higher defect rate, which thus affects the production efficiency and cost.

SUMMARY

The disclosure provides an electrical connector that has a simplified structure and configuration and is capable of preventing improper operation.

An electrical connector of the disclosure includes an insulating body and a plurality of terminals disposed in the insulating body. At least one of the terminals has a first section and a pair of second sections. The pair of second sections structurally extends and branches out from the first section. On a plane where the terminals are located, orthogonal projections of the pair of second sections on the plane are misaligned and do not overlap with each other.

An electrical connector of the disclosure includes an insulating body, a pair of grounding members, a plurality of terminals, and a metallic shell. The insulating body comprises a tongue part. The pair of grounding members are disposed on the inside of opposite lateral sides of the tongue part and partially exposed on the corresponding opposite sides of the tongue part. The terminals are disposed in the insulating body, wherein at least one of the terminals has a first section and a pair of second sections, the pair of second sections structurally extends and branches out from the first section, and on a plane where the terminals are located, the pair of second sections are exposed from the upper and lower surfaces of the tongue part of the insulating body. The metallic shell encloses the insulating body, the pair of grounding members and the plurality of terminals.

In some embodiments, the at least one terminal is a power terminal, the at least one terminal is a ground terminal, or the at least one terminal includes a power terminal and a ground terminal.

In some embodiments, the first section is located on the plane, the second sections are respectively located on opposite upper and lower sides of the plane and are parallel to the plane, and the second sections are misaligned with each other in an arrangement direction of the terminals.

In some embodiments, the first section is located in the insulating body, and the second sections are respectively exposed from the insulating body.

In some embodiments, the at least one terminal further has a third section, each of the second sections is connected between the first section and the third section, and the third section is located on the plane.

In some embodiments, the electrical connector further includes at least one grounding member disposed on the insulating body and located on at least one side of the terminals.

In some embodiments, the electrical connector is an electrical receptacle connector and further includes a circuit board including a plurality of bonding pads, and the adjacent at least one terminal and the grounding member are soldered to the same bonding pad.

In some embodiments, the grounding member has a fourth section and a fifth section, the fifth section is located on the plane and is exposed from a side surface of the insulating body, and the fourth section is located above the first section.

In some embodiments, an orthogonal projection of the fifth section on the plane overlaps with one of the orthogonal projections of the pair of second sections on the plane.

In some embodiments, the adjacent grounding member and the at least one terminal form an integral structure, and orthogonal projections of the pair of second sections and the grounding member on the plane are misaligned and do not overlap with each other.

In some embodiments, the electrical connector is an electrical receptacle connector configured to be mated with an electrical plug connector, the electrical plug connector includes a plurality of terminal pairs, and when the electrical plug connector is mated with the electrical receptacle connector, the terminal pair that is mated with the at least one terminal is structurally abutted against a portion of the second sections in an arrangement direction of the terminals.

In some embodiments, an orthogonal projection of the terminal pair on the plane has a symmetry center at a boundary of the orthogonal projections of the pair of second sections on the plane.

Based on the above, in the electrical connector of the disclosure, among the plurality of terminals disposed in the insulating body, at least one of the terminals has a first section and a pair of second sections, and the second section structurally extend and branch out from the first section.

Meanwhile, the orthogonal projections of the second sections on the plane where the terminals are located are misaligned and in a non-overlapping state with each other. In other words, the terminal having the first section and the branching second sections can adapt to the possible insertion orientation of the user. Namely, regardless of whether the user performs an upside insertion or a reverse insertion operation, the relevant terminals of the mated electrical connectors can be correspondingly abutted against each other, and there is no need to worry about mis-insertion. Moreover, the first section and the branching second sections belong to the same terminal, so there is no need to worry about a wrong electrode polarity, either.

Furthermore, the manufacturing process of the terminal having the first section and the branching second sections can be completed by using only one molding mold. In other words, in the manufacturing process of the terminals, the designer is not required to adopt different molding molds for different portions of the terminal. Accordingly, it is possible to effectively simplify the manufacturing technique and manufacturing cost of the terminals.

To provide a further understanding of the aforementioned and other features and advantages of the disclosure, exemplary embodiments, together with the reference drawings, are described in detail below.

BRIEF DESCRIPTION OF THE DRAWINGS

FIG. 2 is a schematic partial component view of one of the electrical connectors of FIG. 1.

DESCRIPTION OF THE EMBODIMENTS

Figure 1:
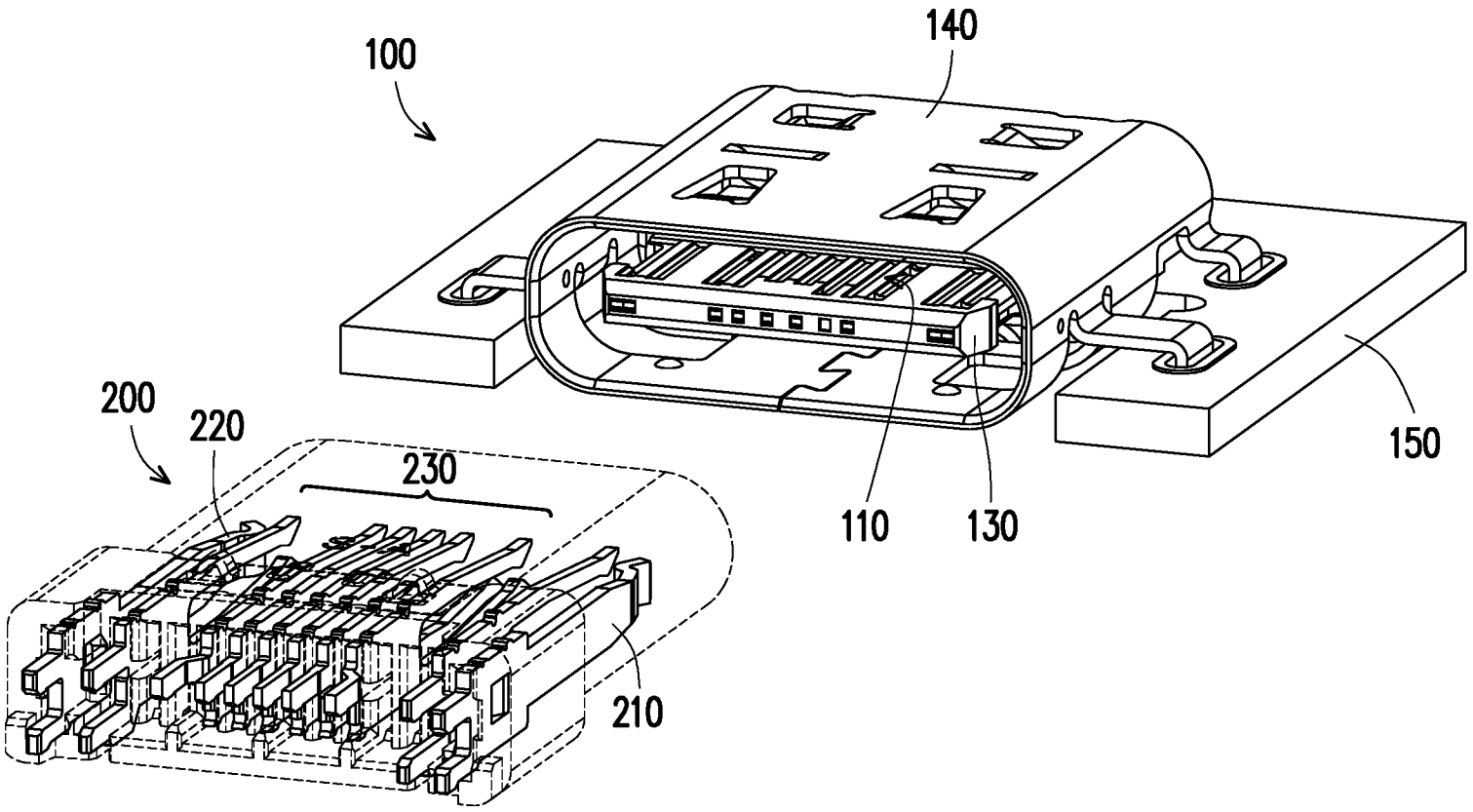
FIG. 1 is a schematic view of a pair of electrical connectors according to an embodiment of the disclosure.
Figure 3:
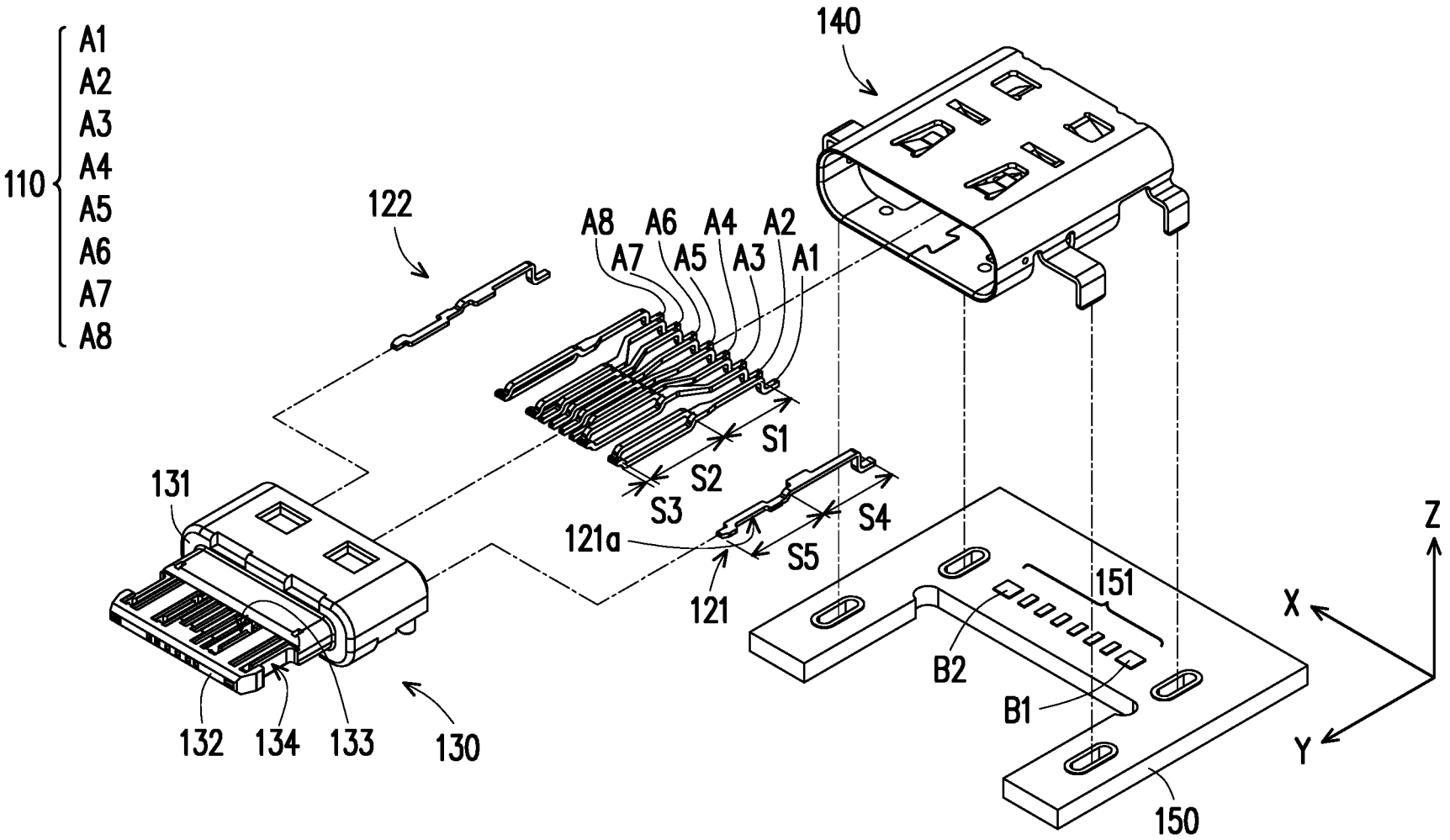
FIG. 3 is an exploded view of one of the electrical connectors of FIG. 1.

FIG. 1 is a schematic view of a pair of electrical connectors according to an embodiment of the disclosure. FIG. 2 is a schematic partial component view of one of the electrical connectors of FIG. 1. FIG. 3 is an exploded view of one of the electrical connectors of FIG. 1. Meanwhile, the disclosure also provides a Cartesian coordinate system X-Y-Z for convenience of component description. Referring to FIG. 1 to FIG. 3, in the embodiment, an electrical connector 100 (e.g., an electrical receptacle connector) is used to be mated with an electrical connector 200 (e.g., an electrical plug connector). The electrical connector 100 includes an insulating body 130, a terminal set 110, a pair of grounding members 121 and 122, a metallic shell 140, and a circuit board 150. The terminal set 110 is disposed in the insulating body 130, and after being combined together, the terminal set 110 and the insulating body 130 are enclosed by the metallic shell 140. Then, the metallic shell 140, along with the insulating body 130 and the terminal set 110 therein, is disposed on the circuit board 150, and the terminal set 110 is correspondingly soldered to a bonding pad set 151 on the circuit board 150 to achieve the effect of electrically connecting the terminal set 110 to the circuit board 150 via the bonding pad set 151. The pair of grounding members 121 and 122 are disposed on the inside of opposite lateral sides of the insulating body 130 and partially exposed on the opposite sides of the insulating body 130. Furthermore, the pair of grounding members 121 and 122 are protruded slightly beyond the corresponding lateral sides of the insulating body 130.

Referring to FIG. 3, in the embodiment, the terminal set 110 is divided into a plurality of terminals A1 to A8. It is noted that the terminals A1, A2, A7, and A8 have different structures from the terminals A3 to A6. Here, the terminals A1 and A8 are ground terminals (GND), the terminals A2 and A7 are power terminals (Vbus/PWR), and the terminals A3 to A6 are, for example, differential signal transmission terminals. It is noted that the disclosure does not limit the transmission form of the terminals A3 to A6, so in an embodiment, the electrical connector 100 may be an electrical connector that is compatible with the USB 2.0 transmission specification. In addition, although the terminals A1, A2, A7, and A8 (ground terminals and power terminals) are shown in the embodiment to have the same branching structure, the disclosure is not limited thereto. Namely, in other unillustrated embodiments, it is possible that only the ground terminals or only the power terminals in the electrical connector have the branching structure.

It is also noted that, in the embodiment, the terminal set 110 is located on the X-Y plane, and the terminals A1 to A8 of the terminal set 110 are distributed and arranged in the X axis. Each terminal is regarded as extending in the positive Y-axis direction, and meanwhile the positive Y-axis direction is also the mating direction of the electrical connector 100. In other words, in the embodiment, the arrangement direction (lateral direction) of the terminals A1 to A8 is regarded as orthogonal to the mating direction of the electrical connector 100 (plugged to the electrical connector 200), and the X-Y plane on which the terminal set 110 is located is formed accordingly.

As shown in FIG. 2 and FIG. 3, the insulating body 130 includes a main body 131, a tongue part 132, and a plurality of open slots 133 (only one of which is labeled in FIG. 3). The tongue part 132 extends from the main body 131, and the open slots 133 are located on the upper and lower surfaces of the tongue part 132. The terminal set 110 is adapted to be embedded in the insulating body 130 by a molding means (e.g., insert molding). Here, with a reference line P2 as the boundary, as the terminals A1 to A8 of the terminal set 110 extend in the positive Y-axis direction, the portion exceeding the reference line P2 is exposed from the insulating body 130, and the portion not exceeding the reference line P2 is covered by the insulating body 130.

Figure 4:
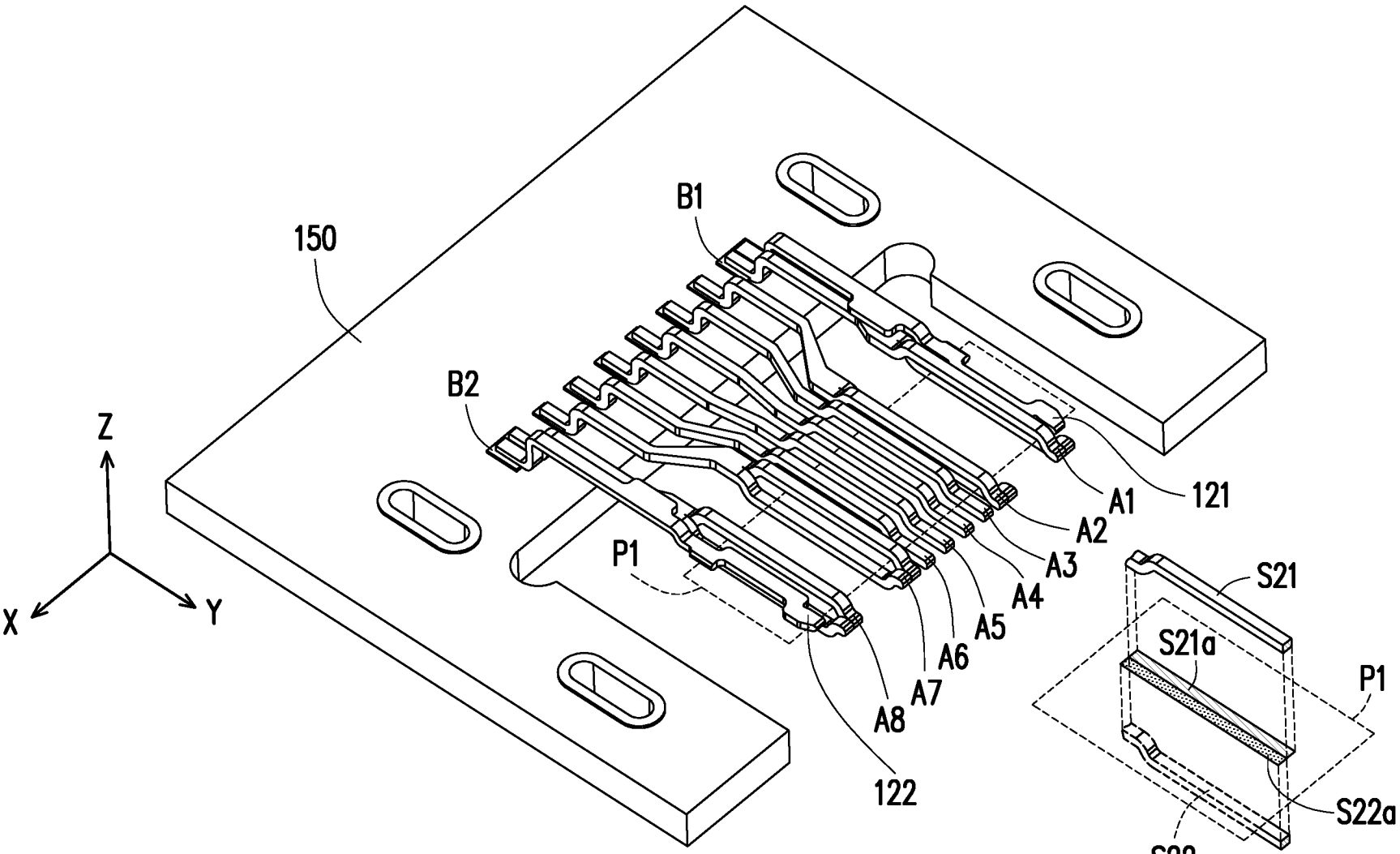
FIG. 4 and FIG. 5 are respectively schematic partial views illustrating the terminal set.
Figure 5:
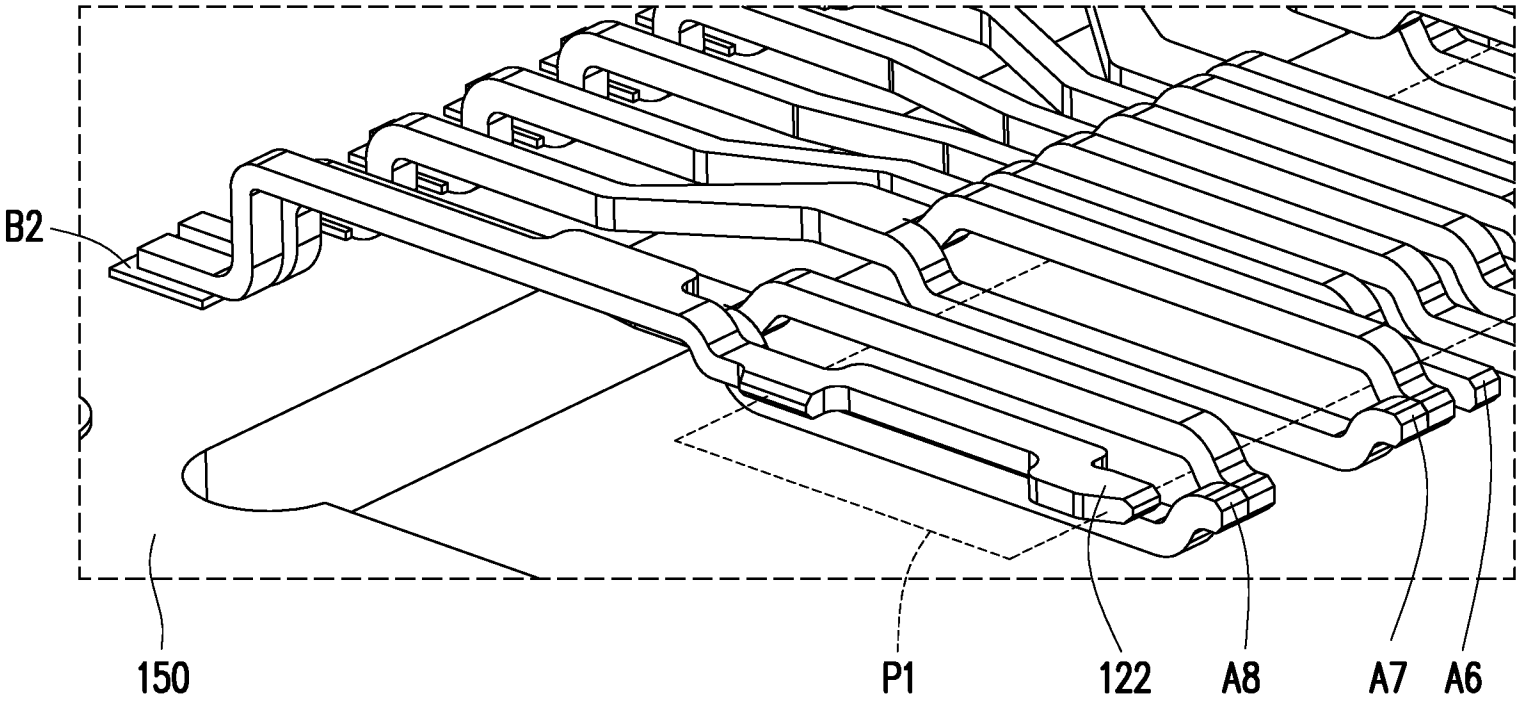

FIG. 4 and FIG. 5 are respectively schematic partial views illustrating the terminal set. FIG. 5 may be regarded as further enlarging a portion of FIG. 4 from another viewing angle, and FIG. 4 additionally provides a disassembly view of the terminal and the plane on the right side of the figure as reference for describing the terminals having the branching structure. Referring to FIG. 3 to FIG. 5 at the same time, here, the terminal A1 is described as an example, and the rest of the terminals A2, A7, and A8 have the same structure and will not be repeatedly described. In the embodiment, the terminal A1 is further divided into a first section S1 and a pair of second sections S2, and the second sections S2 structurally extend and branch out from the first section S1 in the positive Y-axis direction. As the terminal set 110 is retained in the insulating body 130, the first section S1 of the terminal A1 is embedded in the insulating body 130, and the second sections S2 are exposed from the upper and lower surfaces of the tongue part 132 of the insulating body 130 via the open slot 133, and as the terminals A1 to A8 extend in the positive Y-axis direction, the branching position of the structure is located in the insulating body 130. Furthermore, the end of the terminals A1 to A8 away from the tongue part 132 is exposed from the main body 131 to correspond to and be soldered with the bonding pad set 151 of the circuit board 150.

In FIG. 4 and FIG. 5, to clearly describe the correspondence between the first section S1 and the second sections S2, a plane P1 on which the terminal set 110 is located is provided as reference of description, and reference is also made to the disassembly view on the right side of FIG. 4. Here, the second sections S2 are divided into a structure member S21 and a structure member S22. The plane P1 is parallel to the X-Y plane and passes between the pair of second sections S2. Meanwhile, the plane P1 is also consistent with the above conditions for the arrangement direction and the mating direction of the terminals A1 to A8. Accordingly, according to the disassembly view of the second sections S2 and the plane P1 of FIG. 4, it is clear that, in the terminals having the branching structure among the terminals A1 to A8, when the plane P1 is taken as the reference, orthogonal projections S21*a* and S22*a* of the structure members S21 and S22 on the plane P1 are misaligned and do not overlap with each other.

In other words, for the terminal A1, its first section S1 is substantially located on the plane P1, and its second sections S2 are substantially located on the opposite upper and lower sides of the plane P1 and parallel to the plane P1. The structure member S21 is regarded as located above the plane P1, and the structure member S22 is regarded as located below the plane P1. Accordingly, the structure members S21 and S22 both extend in the positive Y-axis direction and structurally branch out from the first section S1, and meanwhile the structure members S21 and S22 are misaligned with each other in the arrangement direction (lateral direction, i.e., X-axis direction) of the terminals A1 to A8.

In addition, the terminal A1 of the embodiment further has a third section S3 located on the plane P1, and the pair of second sections S2 is respectively connected between the first section S1 and the third section S3. In other words, in the positive Y-axis direction, the terminal A1 first structurally branches out from the first section S1 into the pair of second sections S2, and then merges at the third section S3. With this configuration, the terminal A1 can have a better structural strength. Namely, in the molding combination process with the insulating body 130, the first section S1 and the third section S3 can both be covered in the insulating body 130 to prevent the second sections S2 from protruding out of the insulating body 130.

Based on the above, in the electrical connector 100, since the ground terminals and/or the power terminals have the above branching structure (i.e., the same terminal has a structural configuration in which the upper and lower parts are mirror images with respect to the plane P1), in a mating process of the electrical connectors 100 and 200, mating is not affected by the difference in the upside and reverse insertion modes. Namely, there is no need to worry about damage to the terminals of the electrical connector due to mis-insertion.

Figure 6:
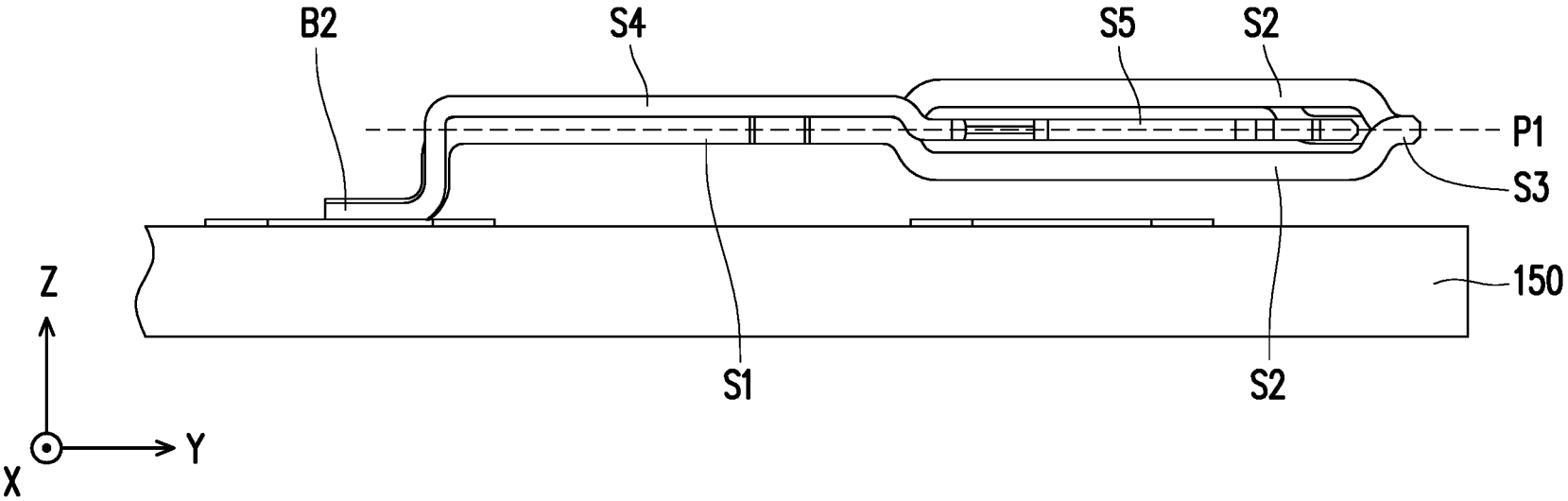
FIG. 6 is a partial side view illustrating the electrical connector of FIG. 4.

FIG. 6 is a partial side view showing the electrical connector of FIG. 4. Referring to FIG. 4 to FIG. 6 at the same time, in the embodiment, the grounding members 121 and 122 of the electrical connector 100 are respectively disposed on two opposite sides in the arrangement direction (X-axis direction) of the terminal set 110, and the grounding members 121 and 122 and the terminal set 110 are together retained in the insulating body 130. The pair of grounding members 121 and 122 are disposed on the inside of opposite lateral sides of the tongue part 132 and partially exposed on the opposite sides of the tongue part 132. Furthermore, the pair of grounding members 121 and 122 are protruded slightly beyond the corresponding lateral sides of the tongue part 132. Furthermore, as the grounding members 121 and 122 are adjacent to the ground terminals (the terminals A1 and A8) of the terminal set 110, in the embodiment, the grounding member 121 is soldered onto a bonding pad B1 of the bonding pad set 151 together with the terminal A1, and the grounding member 122 is soldered onto a bonding pad B2 of the bonding pad set 151 together with the terminal A8. Accordingly, the configuration of the bonding pad set 151 on the circuit board 150 can be further simplified, and the electrical connector 100 can have a consistent ground potential.

On the other hand, the grounding members 121 and 122 are adjacent to the terminals A1 and A8 and exhibit a state of partial overlap along the X axis. Here, the grounding members 121 and 122 are respectively further divided into a fourth section S4 and a fifth section S5, and the fourth section S4 is located above the first section S1 (i.e., above the plane P1), so the orthogonal projection of the fifth section S5 on the plane P1 overlaps with one of the orthogonal projections of the second sections S2 on the plane P1. Meanwhile, the fifth section S5 is located on the plane P1 and is exposed from a side surface recess 134 of the insulating body 130, as shown in FIG. 2.

Figure 7:
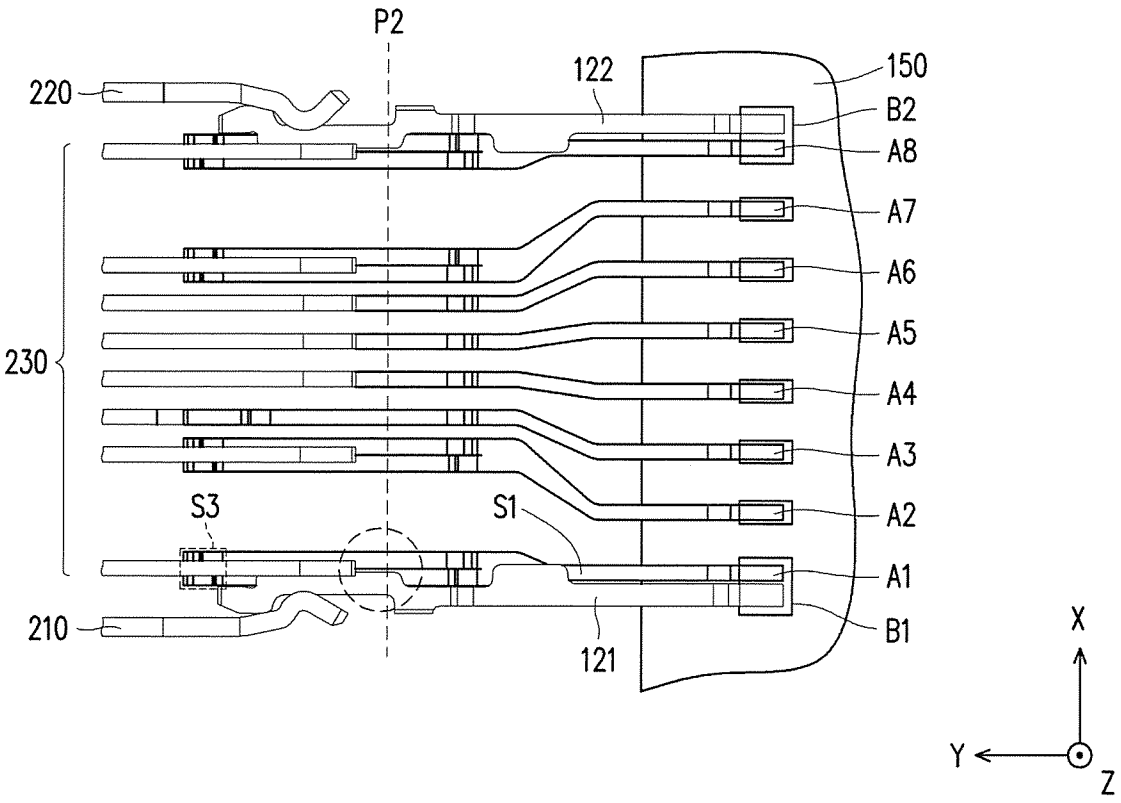
FIG. 7 is a schematic partial component view of the electrical connectors when mated as viewed from the top.
Figure 7A:
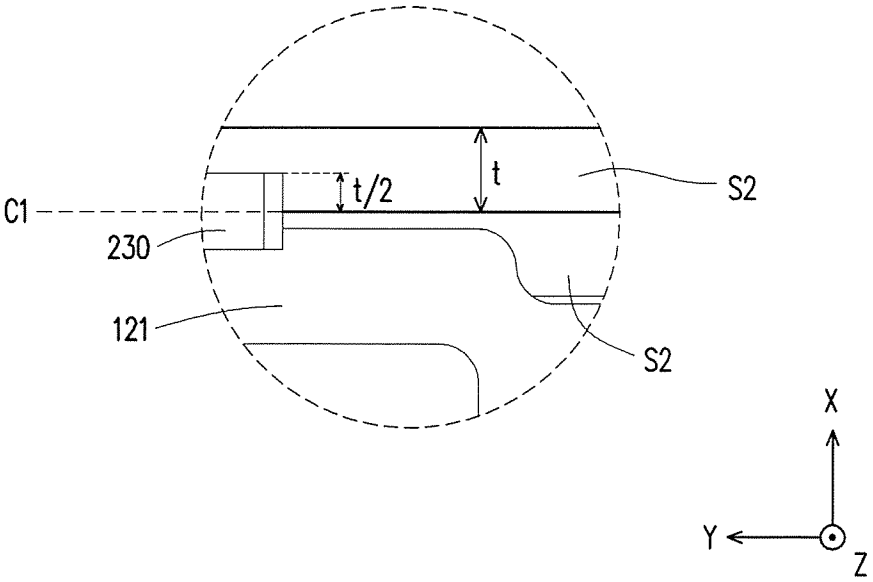
FIG. 7A is an enlarged view in dash circle of FIG. 7.
Figure 8:
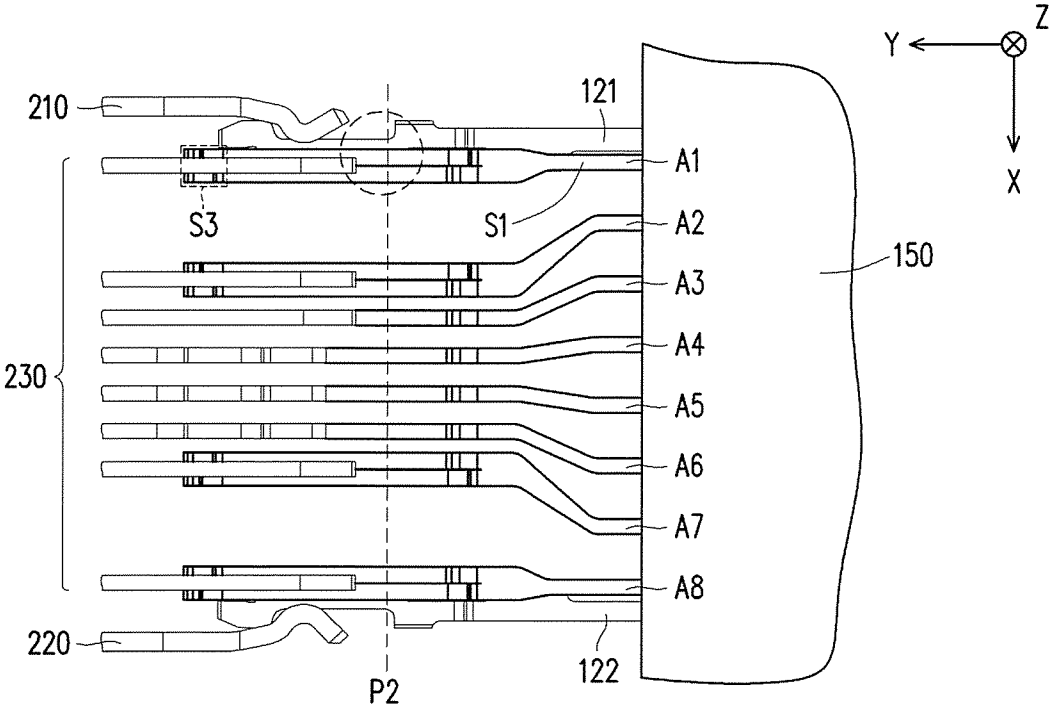
FIG. 8 is a schematic partial component view of the electrical connectors when mated as viewed from the bottom.
Figure 8A:
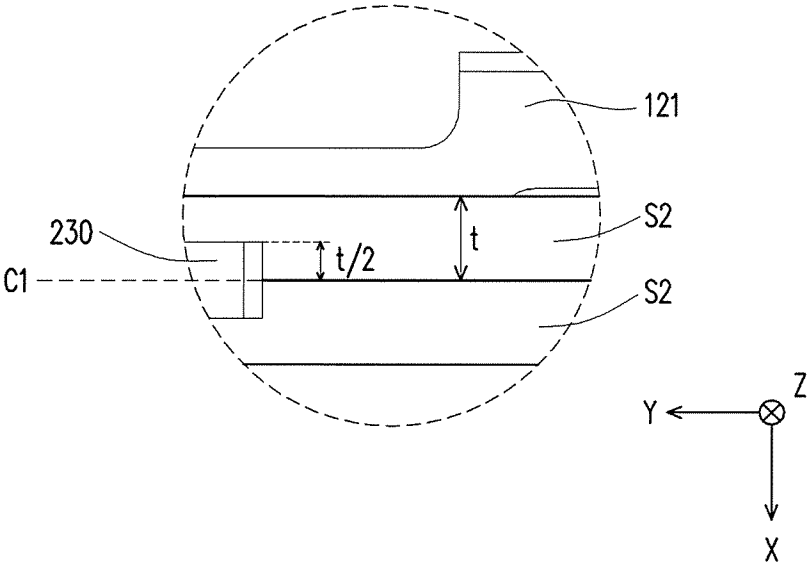
FIG. 8A is an enlarged view in dash circle of FIG. 8.

FIG. 7 is a schematic partial component view of the electrical connectors when mated as viewed from the top. FIG. 8 is a schematic partial component view of the electrical connectors when mated as viewed from the bottom. Referring to FIG. 7 and FIG. 8 at the same time, the electrical connector 200 includes a terminal set 230 and grounding side latches 210 and 220. All terminals of the terminal set 230 are arranged between the grounding side latches 210 and 220, and the terminals of the terminal set 230 are configured as terminal pairs in the Z axis. When the electrical connectors 100 and 200 are mated with each other, since the grounding member 121 has an abutting part 121*a* exposed from the side surface recess 134 in the fifth section S5, the grounding side latch 210 of the electrical connector 200 is correspondingly fastened at the side surface recess 134 and is also structurally abutted against the abutting part 121*a*, which thereby provide proper mechanical and electrical mating of the plug connector to the electrical receptacle connector, so as to make ground connections and thus to provide a ground path during insertion of the electrical plug connector to the electrical receptacle connector. Here, since the electrical connector 200 is compatible with the technical specification of existing electrical plug connectors, the detailed structure thereof will not be described herein.

It is noted that, although part of the terminals of the electrical connector 100 have a branching structure, the relationship of structural abutment and electrical connection with the terminal set 230 of the electrical connector 200 can still be maintained. Specifically, when the electrical connector 200 is mated with the electrical connector 100, the terminal pairs that are mated with the terminals A1, A2, A7, and A8 are structurally abutted against a portion of the second sections S2 in the arrangement direction of the terminals A1 to A8 (lateral direction, i.e., X-axis direction), as shown in the partially enlarged views of FIG. 7 and FIG. 8. The orthogonal projection of the terminal pair on the plane P1 has a symmetry center at the boundary of the orthogonal projections of the second sections S2 on the plane P1.

More specifically, the bottom view (FIG. 8) and the top view (FIG. 7) are taken here as the reference corresponding to the above description of the orthogonal projections, and the terminal A1 is taken as an example. For the terminal A1, the pair of second sections S2 thereof is adjacent to each other and has a symmetry center C1, for example. When the electrical connectors 100 and 200 are mated with each other, since the pair of second sections S2 is misaligned in the X axis, the terminal pair of the terminal set 230 is actually respectively abutted against a portion of each of the second sections S2, preferably by a half of a size t of the second section S2 in the X axis, i.e., a size t/2 as shown. In other words, the same terminal pair of the terminal set 230 corresponds to each other in the Z axis (configured as mirror images with respect to the X-Y plane). Therefore, when the terminal pair corresponds to the pair of misaligned second sections S2, one of the terminal pair is abutted against a portion of one of the second sections S2 (the structure member S21), and the other one of the terminal pair is abutted against a portion of the other one of the second sections S2 (the structure member S22). Moreover, when measured based on the terminal width (i.e., the size of the terminal A1 in the X axis), the terminal pair is respectively abutted against a half of the width of the second section S2. Here, the width of the terminal A1 in the second section S2 is the size t, and the width of the second section S2 abutted against the terminal pair of the terminal set 230 is the size t/2.

Figure 9:
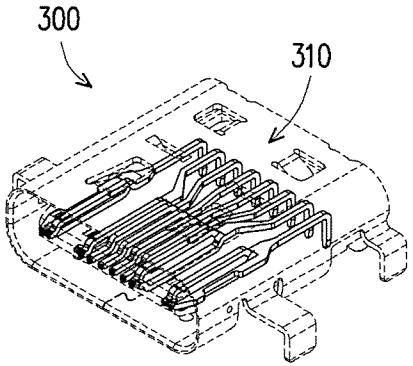
FIG. 9 is a schematic view of an electrical connector of another embodiment of the disclosure.
Figure 9A:
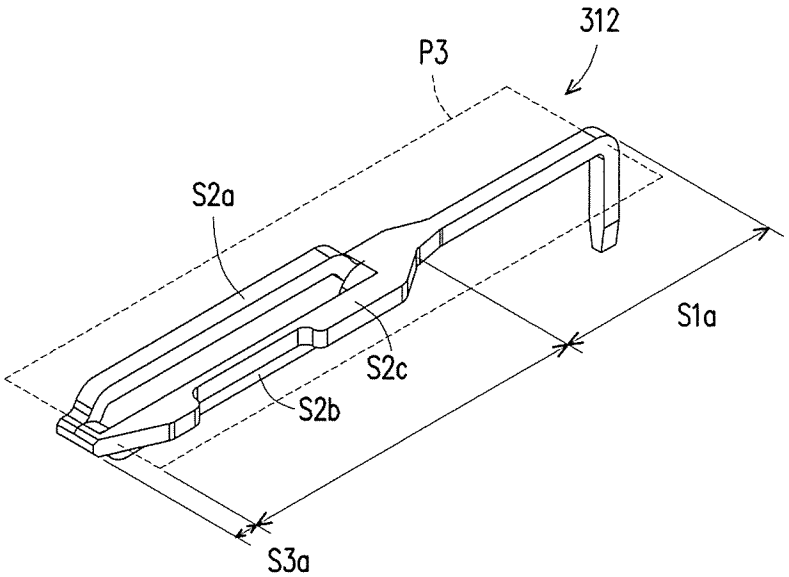
FIG. 9A is an enlarged view of one terminal of FIG. 9.

FIG. 9 is a schematic view of an electrical connector of another embodiment of the disclosure. Here, the non-terminal components are shown in broken lines, so that the contours of the terminals shown in solid lines can be clearly identified. In a terminal set 310 of an electrical connector 300, at least one terminal has the branching structure described above. A partially enlarged view of the terminal is provided on the right side of the figure, and a plane P3 is used as the reference basis. Taking a (ground) terminal 312 as an example, similar to the embodiment above, the terminal 312 also has second sections S2*a* and S2*b* that are misaligned with each other. Namely, the terminal 312 also structurally extends from a first section S1*a*, branches out into a pair of second sections S2*a* and S2*b*, and then merges into a third section S3*a*. However, different from the embodiment above, the grounding member of the embodiment actually has a structural feature of being integrally formed with the (ground) terminal 312.

Namely, in the extending direction of the terminal 312, the grounding member has a second section S2*c* corresponding to the same range of the second sections S2*a* and S2*b*, and the orthogonal projections of the second sections S2*a*, S2*b*, and S2*c* on the plane P3 are mutually (laterally) misaligned and do not overlap with each other. However, for the first section S1*a* and the third section S3*a*, the grounding member and the ground terminal share a single structure. With this configuration of combining the grounding member and ground terminal that are adjacent to each other, it is possible to further simplify the structure and the required manufacturing technique and cost.

In summary of the above, in the above embodiments of the disclosure, the ground terminals or/and the power terminals of the electrical connector have a branching structure. Namely, the ground terminals or/and the power terminals each have a common first section and branching and misaligned second sections, and, in addition to branching out in the extending direction of the terminals, the second sections are further misaligned in the arrangement direction of the terminals. Accordingly, with the horizontal symmetry design of the ground terminals or/and the power terminals, the electrical connector can provide the function that allows upside and reverse insertion modes of the electrical connector connected thereto and prevent damage to the terminals due to mis-insertion by the user.

Furthermore, the manufacturing process of the terminal having the first section and the branching second sections can be completed by using only one molding mold. In other words, in the manufacturing process of the terminals, the designer is not required to adopt different molding molds for different portions of the terminal. Accordingly, it is possible to effectively simplify the manufacturing technique and manufacturing cost of the terminals.

What is claimed is:

1. An electrical connector comprising:

an insulating body; and a plurality of terminals disposed in the insulating body and arranged in a lateral direction, wherein at least one of the terminals has a first section and a pair of second sections, the pair of second sections structurally extends and branches out from the first section, and on a plane where the terminals are located, orthogonal projections of the pair of second sections on the plane are misaligned and do not overlap with each other, wherein the electrical connector is an electrical receptacle connector mated with an electrical plug connector in a mating direction, the electrical plug connector comprises a plurality of terminal pairs, and when the electrical plug connector is mated with the electrical receptacle connector, the terminal pair that is mated with the at least one terminal is structurally abutted against a portion of the second sections in the lateral direction of the terminals of the electrical receptacle connector, wherein the lateral direction is orthogonal to the mating direction.

2. The electrical connector according to claim 1, wherein the at least one terminal is a power terminal, the at least one terminal is a ground terminal, or the at least one terminal comprises a power terminal and a ground terminal.

3. The electrical connector according to claim 1, wherein the first section is located on the plane, the pair of second sections is located on opposite upper and lower sides of the plane and are parallel to the plane, and the pair of second sections is misaligned with each other in an arrangement direction of the terminals.

4. The electrical connector according to claim 1, wherein the first section is located in the insulating body, and the pair of second sections is respectively exposed from the insulating body.

5. The electrical connector according to claim 1, wherein the at least one terminal further has a third section, each of the second sections is connected between the first section and the third section, and the third section is located on the plane.

6. The electrical connector according to claim 1, further comprising: at least one grounding member disposed on the insulating body and located on at least one side of the terminals.

7. The electrical connector according to claim 6, wherein the electrical connector is an electrical receptacle connector and further comprises a circuit board comprising a plurality of bonding pads, and the at least one terminal and the grounding member are adjacent to each other and soldered to the same bonding pad.

8. The electrical connector according to claim 6, wherein the grounding member has a fourth section and a fifth section, the fifth section is located on the plane and is exposed from a side surface of the insulating body, and the fourth section is located above the first section.

9. The electrical connector according to claim 8, wherein an orthogonal projection of the fifth section on the plane overlaps with one of the orthogonal projections of the pair of second sections on the plane.

10. The electrical connector according to claim 6, wherein the grounding member and the at least one terminal are adjacent to each other and form an integral structure, and orthogonal projections of the pair of second sections and the grounding member on the plane are misaligned and do not overlap with each other.

11. The electrical connector according to claim 1, wherein an orthogonal projection of the terminal pair on the plane has a symmetry center at a boundary of the orthogonal projections of the pair of second sections on the plane.

12. An electrical connector comprising:

an insulating body comprising a tongue part; and a pair of grounding members disposed on the inside of opposite lateral sides of the tongue part and partially exposed on the corresponding opposite sides of the tongue part;

a plurality of terminals disposed in the insulating body and arranged in a lateral direction, wherein at least one of the terminals has a first section and a pair of second sections, the pair of second sections structurally extends and branches out from the first section, and on a plane where the terminals are located, the pair of second sections are exposed from the upper and lower surfaces of the tongue part of the insulating body; and a metallic shell encloses the insulating body, the pair of grounding members and the plurality of terminals, wherein the electrical connector is an electrical receptacle connector mated with an electrical plug connector in a mating direction, the electrical plug connector comprises a plurality of terminal pairs, and when the electrical plug connector is mated with the electrical receptacle connector, the terminal pair that is mated with the at least one terminal is structurally abutted against a portion of the second sections in the lateral direction of the terminals of the electrical receptacle connector, wherein the lateral direction is orthogonal to the mating direction.

13. The electrical connector according to claim 12, wherein orthogonal projections of the pair of second sections on the plane are misaligned and do not overlap with each other.

14. The electrical connector according to claim 12, wherein the at least one terminal is a power terminal, the at least one terminal is a ground terminal, or the at least one terminal comprises a power terminal and a ground terminal.

15. The electrical connector according to claim 12, wherein the first section is located on the plane, the pair of second sections is located on opposite upper and lower sides of the plane and are parallel to the plane, and the pair of second sections is misaligned with each other in an arrangement direction of the terminals.

16. The electrical connector according to claim 12, wherein the first section is located in the insulating body, and the pair of second sections is respectively exposed from the insulating body.

17. The electrical connector according to claim 12, wherein the pair of grounding members are protruded slightly beyond the corresponding lateral sides of the tongue part.

* * * * *